US007624471B2

(12) United States Patent
Bae

(10) Patent No.: US 7,624,471 B2
(45) Date of Patent: Dec. 1, 2009

(54) MAT VACUUM CLEANING MACHINE

(76) Inventor: Sang-Choi Bae, 101-1703, Yongsan2-cha Taewang Town, Yongsandong, Dalseo-gu, Daegu (KR) 704-130

( * ) Notice: Subject to any disclaimer, the term of this patent is extended or adjusted under 35 U.S.C. 154(b) by 53 days.

(21) Appl. No.: 11/667,997

(22) PCT Filed: Nov. 3, 2005

(86) PCT No.: PCT/KR2005/003694

§ 371 (c)(1),
(2), (4) Date: Mar. 14, 2008

(87) PCT Pub. No.: WO2006/054840

PCT Pub. Date: May 26, 2006

(65) Prior Publication Data

US 2008/0189902 A1 Aug. 14, 2008

(30) Foreign Application Priority Data

Nov. 18, 2004 (KR) ..... 10-2004-0094667

(51) Int. Cl.
*A47L 7/00* (2006.01)
*A47L 25/00* (2006.01)
*D06G 1/00* (2006.01)

(52) U.S. Cl. ..... 15/303; 15/306.1; 15/308; 15/312.1

(58) Field of Classification Search ..... 15/303, 15/306.1, 308, 312.1; *A47L 7/00, 25/00; D06G 1/00*
See application file for complete search history.

(56) References Cited

U.S. PATENT DOCUMENTS

| | | | | |
|---|---|---|---|---|
| 2,986,149 | A * | 5/1961 | Van Brakel | 134/64 R |
| 4,926,520 | A * | 5/1990 | Watson | 15/302 |
| 2002/0078523 | A1 * | 6/2002 | Ball | 15/268 |
| 2009/0056053 | A1 * | 3/2009 | Kolquist | 15/322 |

FOREIGN PATENT DOCUMENTS

| | | | |
|---|---|---|---|
| JP | 6-071240 | A | 3/1994 |
| JP | 6-039177 | U | 5/1994 |
| JP | 8-323313 | A | 12/1996 |
| KR | 20-0305998 | Y | 3/2003 |
| KR | 20-0321403 | Y | 7/2003 |
| KR | 10-2003-0085541 | A1 | 11/2003 |

* cited by examiner

*Primary Examiner*—David A Redding
(74) *Attorney, Agent, or Firm*—Birch, Stewart, Kolasch & Birch, LLP

(57) ABSTRACT

Disclosed herein is a mat vacuum cleaning machine in which a vacuum suction device is installed in a rear region of the machine and is adapted to vacuum suction and remove moisture, impurities, and bacteria in a washed mat so as to effect a rapid drying of the mat, and an electric heating device is installed near the vacuum suction device to heat the mat, which was inevitably deformed and wrinkled in the previous washing and drying processes, to a predetermined temperature from 30° C. to 60° C. so as to evenly smoothen the mat, resulting in an improvement in cleanness of the automotive passenger compartment using the mat.

11 Claims, 8 Drawing Sheets

MAT VACUUM CLEANING MACHINE

TECHNICAL FIELD

The present invention relates to a vacuum cleaning machine for washing automotive mats, and more particularly, to a mat vacuum cleaning machine which comprises a vacuum suction device installed in a rear region of the machine and adapted to vacuum suction moisture, impurities, and bacteria in a washed mat so as to effect a rapid drying of the mat, and an electric heating device having a predetermined high temperature and installed near the vacuum suction device to heat and smoothen the dried mat.

BACKGROUND ART

Automotive mat cleaning machines of the prior art are disclosed in a number of patents, for example, Korean Registered Utility Models No. 20-183694 and No. 20-200213. The disclosed mat cleaning machines are commonly configured in such a fashion that, starting from a mat entrance opening, a wash water spray nozzle device, upper and lower mat transfer rollers, a brush roller, and a pair of upper and lower dewatering rollers are arranged in sequence, and the upper mat transfer roller and the upper dewatering roller are adapted to be vertically raised or lowered under operation of manual levers or cylinders, so as to fulfill mat washing and drying functions.

In the above described prior art, although the dewatering rollers are installed in the rear region of the cleaning machine to absorb moisture in the washed mat, the dewatering rollers are incapable of completely removing moisture in the washed mat and thus disabling immediate use of the mat. Such an insufficient drying of the mat results in a deteriorative performance in clearness of the mat due to impurities or bacteria still remaining in the mat. Further, it takes a great deal amount of time to dry the mat sufficient to prevent contamination of the wet mat in use.

DISCLOSURE OF INVENTION

Technical Problem

Therefore, the present invention has been made in view of the above problems, and it is an object of the present invention to provide a mat vacuum cleaning machine in which a vacuum suction device and a vacuum generating device are installed in a rear region of the machine and are adapted to vacuum suction wash water, impurities, and bacteria remaining in a washed mat, so as to effect a rapid drying of the mat.

It is a further object of the present invention to provide a mat vacuum cleaning machine in which one or more electric heating devices are installed near a vacuum suction device, namely, at a front end and/or a rear end of the vacuum suction device, and are adapted to be heated to a predetermined high temperature for ensuring effective operation thereof even in the winter and heating the mat to a temperature from 30° C. to 60° C. so as to evenly smoothen the mat.

It is another object of the present invention to provide a mat vacuum cleaning machine comprising a vacuum suction device, which is longitudinally formed with a plurality of suction holes, the length of the respective suction holes gradually increasing toward one end of the vacuum suction device to effect a variable suction force, in order to prevent the mat from sticking to the vacuum suction device and ensure smooth discharge of the mat.

It is yet another object of the present invention to provide a mat vacuum cleaning machine in which pairs of vacuum suction devices and vacuum generating devices are installed, respectively, above and below a mat transfer path to vacuum suction moisture, impurities, and bacteria remaining in a washed mat, so as to effect a rapid drying of the mat.

Technical Solution

In accordance with the present invention, the above and other objects can be accomplished by the provision of a mat vacuum cleaning machine comprising: a mat entrance opening and a mat exit opening formed at opposite sides of an upper portion of a machine body; a mat transfer path defined between the mat entrance opening and the mat exit opening to effect washing, vacuum-suction, drying and discharge processes on a mat; a vacuum suction device formed with a plurality of longitudinally arranged suction holes, the length of the respective suction holes gradually increases toward one end of the vacuum suction device to achieve a variable suction force, thereby allowing the mat to be smoothly discharged without sticking to the vacuum suction device; and an electric heating device installed near the vacuum suction device and adapted to heat the washed and dried mat to a predetermined heating temperature from 30° C. to 60° C. so as to evenly smoothen the mat.

Advantageous Effects

The present invention provides a vacuum cleaning machine for washing and drying automotive mats in which a vacuum suction device is located in a rear region of the machine and is adapted to vacuum suction and remove wash water, impurities and bacteria remaining in the washed mat, so as to effect a rapid drying of the mat and to enable the immediate use thereof. The mat vacuum cleaning machine of the present invention can largely reduce a time required to dry the mat as compared to the prior art, and consequently can contribute to achieve cleanness of an automotive passenger compartment.

Further, the present invention employs an electric heating device, which is installed near the vacuum suction device so as to heat the washed and dried mat to a temperature from 30° C. to 60° C., thereby being capable of evenly smoothening the mat.

Furthermore, according to the present invention, the vacuum suction device is formed on the top thereof with a plurality of longitudinally arranged suction holes. The length of the respective suction holes gradually increases toward one end of the vacuum suction device to achieve a variable suction force. This has the effect of allowing the mat to be smoothly discharged from the machine without sticking to the vacuum suction device.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be explained with reference to the accompanying drawings.

The mat vacuum cleaning machine of the present invention has a function of washing a mat by use of wash water, and additionally employs at least one vacuum pump for vacuum suction, The vacuum pump has an air suction pressure within a range from the atmospheric pressure to a value close to the absolute vacuum. Therefore, it can be said that the vacuum pump is very useful for the absorbent washing of the mat. However, applying the vacuum pump to a washing operation using wash water is very difficult. This is because the vacuum pump has the characteristic of showing a degradation in the degree of vacuum if the level of pollution thereof rises due to impurities including water within an interior chamber of the pump, thereby suffering from malfunction and in the worst case, having a mechanical trouble.

In an embodiment of the present invention, the mat vacuum cleaning machine comprises a vacuum suction device and a vacuum generating device including at least one vacuum pump. With this configuration, after washing a mat with water, moisture, impurities, and bacteria remained in the washed mat can be vacuum suctioned while guaranteeing normal operation of the vacuum pump.

Figure 1:
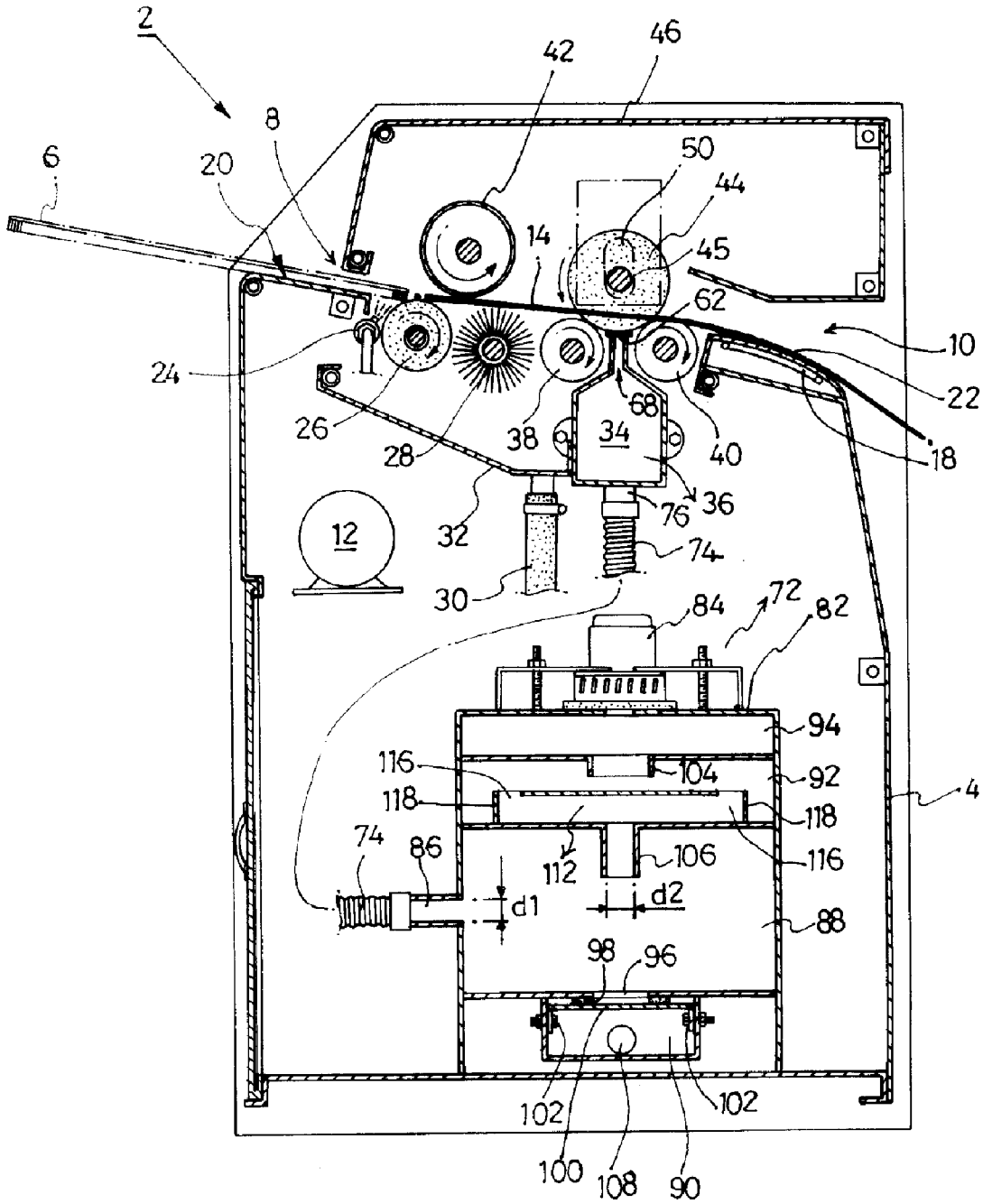
FIG. 1 is a front sectional view of a vacuum cleaning machine according to an embodiment of the present invention.
Figure 2:
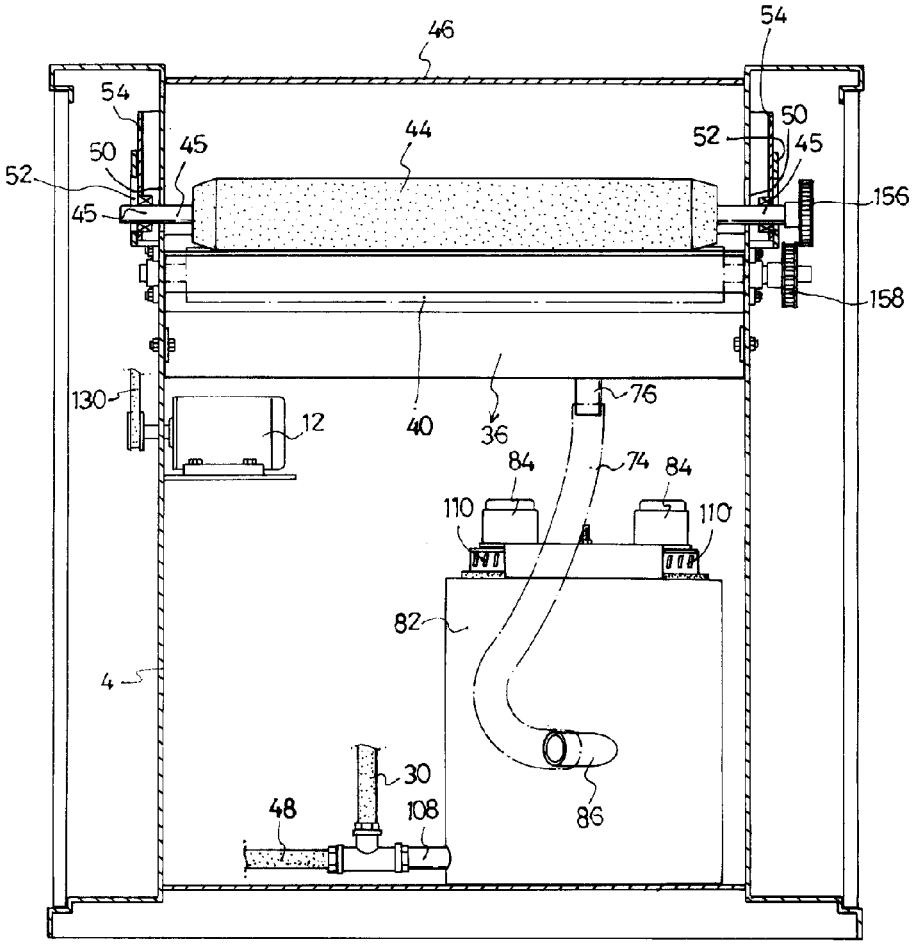
FIG. 2 is a partial side sectional view of a vacuum suction device according to the embodiment of the present invention.

FIGS. 1 and 2 are a front sectional view and a side sectional view, respectively, Illustrating a mat vacuum cleaning machine according to an embodiment of the present invention.

Considering the configuration of the mat vacuum cleaning machine of the present invention, designated as reference numeral 2, the machine 2 has a body 4 formed at opposite sides of an upper portion there with a mat entrance opening 8 and a mat exit opening 10. Between the mat entrance opening 8 and the mat exit opening 10 is defined a mat transfer path 14, and are arranged, in sequence, a power supply unit, such as a motor 12, a plurality of power transmission devices and driving and driven mechanisms to effect washing, vacuum-suction, drying and discharge processes on a mat 6 entered through the entrance opening 8 and transferred toward the discharge opening 10. At a distal end of the mat transfer path 14 is located a vacuum suction device 36. The vacuum suction device 36 is adapted to vacuum suction and remove moisture, impurities, and bacteria remaining in the mat conveyed after completing the washing process, so as to effect a rapid drying of the mat 6. Near the vacuum suction device 36 is provided an electric heating device 18. The electric heating device 18 is heated to a temperature from 30 C to 60 C to heat and evenly smoothen the washed and vacuum dried mat 6.

Below the mat transfer path 14 are provided, in sequence, a wash water spray nozzle device 24, a driving roller 26, a brush roller 28, a water basin 32 having a drain pipe or hose 30, the vacuum suction device 36 internally defining a vacuum chamber 34, guide rollers 38 and 40 located at opposite sides of the vacuum suction device 36, and the electric heating device 18 in the form of an electric heater. On the other hand, above the mat transfer path 14 are provided a pressure roller 42, and an absorption roller 44. Here, the rollers 26, 28, 38, 40, 42 and 44 may be installed on respective shaft rods. In addition, a protective case 46 is installed to cover the top of the vacuum cleaning machine 2.

The water basin 32, extending below the wash water spray nozzle device 24, the driving roller 26 and the brush roller 28, serves to collect the used wash water, impurities, etc. falling from the washed mat 6. The collected wash water and impurities are discharged to the outside through the drain hose 30 of the basin 32 and a discharge pipe 48 connected to the drain hose 30.

Figure 6:
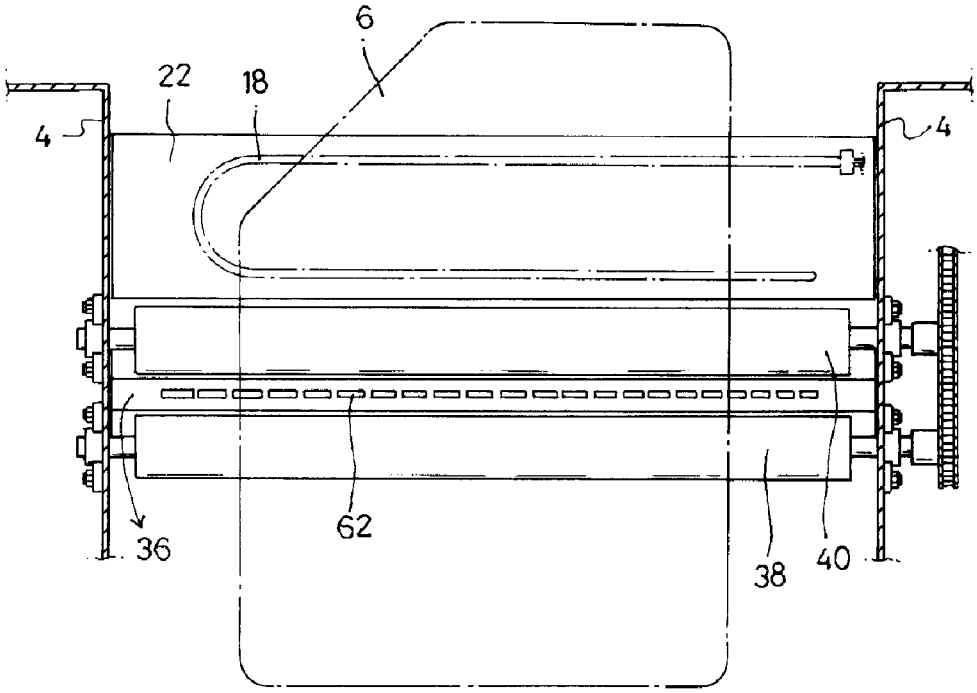
FIG. 6 is a partial plan view of the vacuum suction device according to the embodiment of the present invention.

All of the above described rollers 26, 28, 38, 40, 42 and 44 have an axially elongated rectangular form as shown in FIGS. 2 and 6. Similar to the rollers 26, 28, 38, 40, 42 and 44, the vacuum suction device 36 and the spray nozzle device 24 have an elongated form extending parallel to the rollers 26, 28, 38, 40, 42 and 44. The spray nozzle device 24 may be a linear extension portion integrally formed at a wash water supply pipe and directed at a predetermined angle with respect to the supply pipe to effect angled sprays, or a plurality of nozzle units may be equidistantly installed to the wash water supply pipe.

As can be seen from FIG. 1, in order to facilitate initial entrance and washing of the mat 6, the pressure roller 42 is spaced apart from both the driving roller 26 and the brush roller 28 by sufficient distances. Further, in order to ensure effective removal of moisture in the mat 6, the absorption roller 44 is positioned to closely adjacent to or come into contact with the guide rollers 38 and 40, located at the opposite sides of the vacuum suction device 36, as well as suction holes 62 formed on top of the vacuum suction device 36.

The absorption roller 44 is made of sponge or relatively soft fine porous material for facilitating moisture absorption, and is elastically supported in a vertically movable manner by means of lifting means and elastic supporting means. The lifting and elastic supporting means are installed on a pair of shaft rods 45 protruding outward from opposite ends of the absorption roller 44. With such a configuration, the absorption roller 44 is raised or lowered in consideration of the thickness or surface conditions of the washed mat 6, so that it comes into close contact with an upper surface of the mat 6, and absorbs the moisture in the mat 6 as it is rotated by the moving mat 6.

Considering the configuration of the lifting means installed on the shaft rod 45 of the absorption roller 44 with reference to FIGS. 1 to 4, the lifting means comprises a guiding member 52 fixedly mounted to the body 4 and having an open upper surface, a lifting member 54 vertically movably coupled to the guiding member 52, a pair of vertically elongated slots 56 perforated at opposite lateral portions of the guiding member 52, and guiding pins 58 fastened through opposite lateral portions of the lifting member 54 to be inserted into the respective elongated slots 56. The lifting member 54 is axially coupled to the shaft rod 45 of the absorption roller 44 by interposing a bearing. In order to ensure free vertical movement of the shaft rod 45, a portion of the body 4 through which the shaft rod 45 penetrates is formed with a vertically elongated slot 50.

Figure 3:
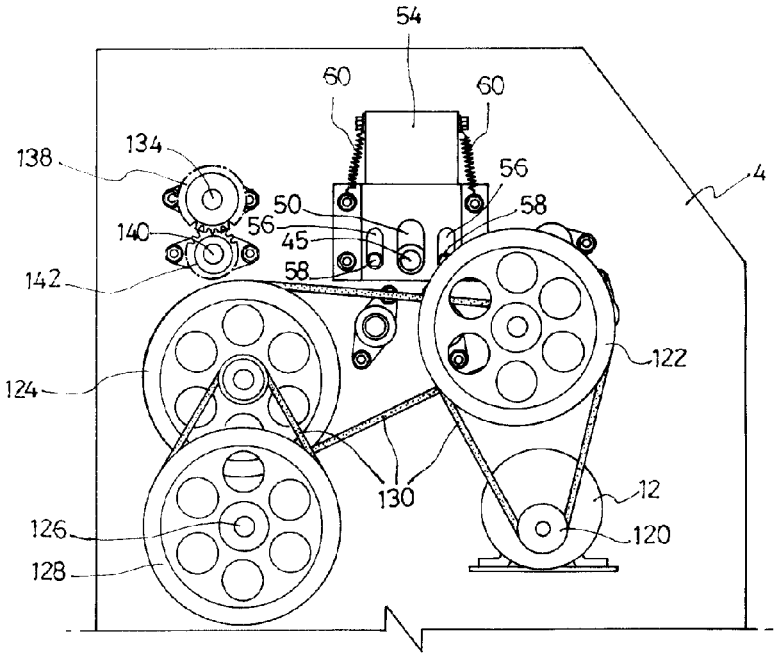
FIG. 3 is a partial rear sectional view of power transmission means, more particularly, pulleys according to the embodiment of the present invention.
Figure 4:
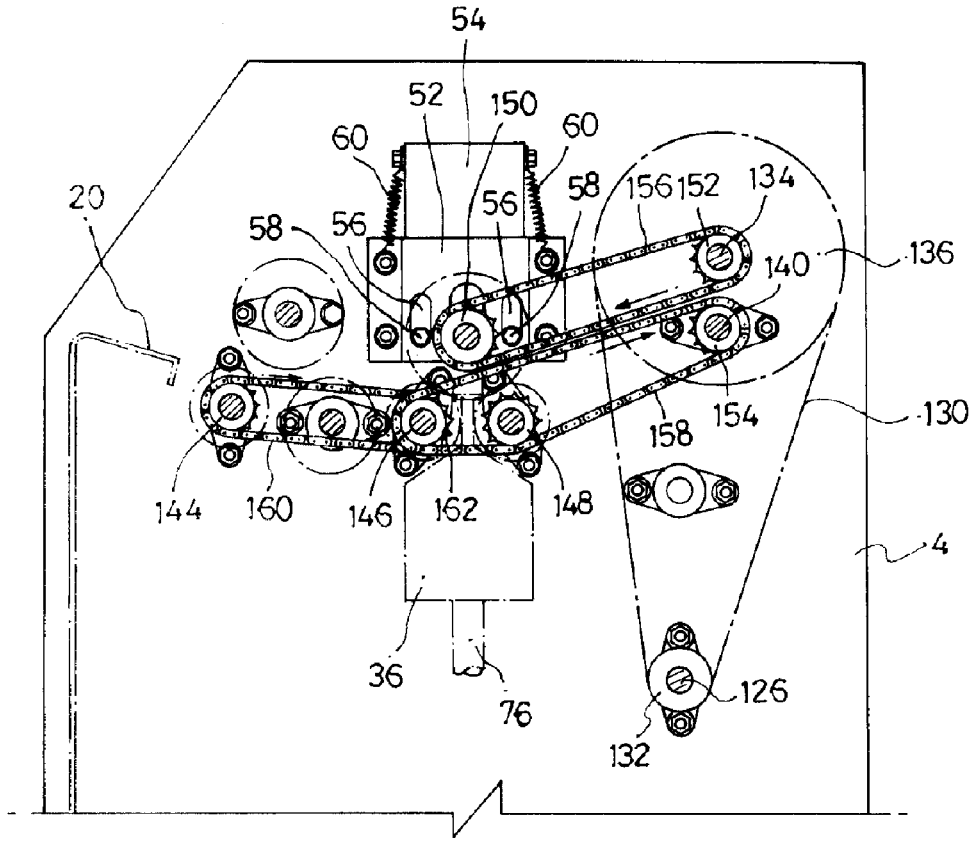
FIG. 4 is a partial front sectional view of power transmission means, more particularly, chain gears according to the embodiment of the present invention.
Figure 5:
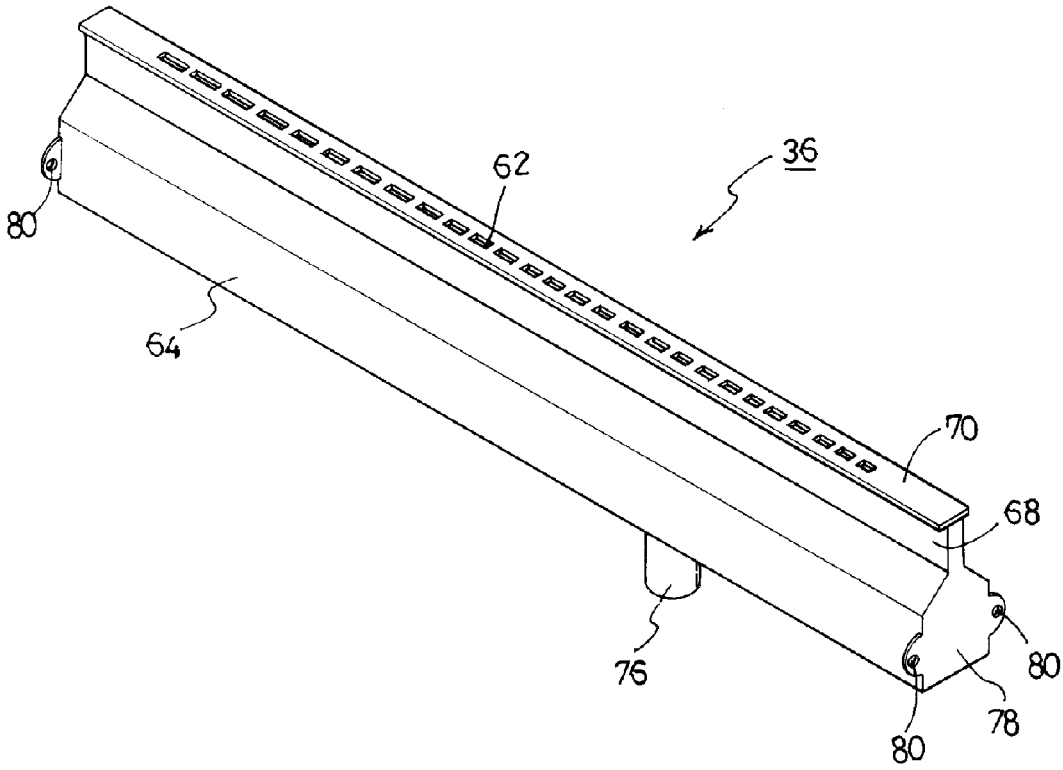
FIG. 5 is a perspective view of the vacuum suction device according to the embodiment of the present invention.

The elastic supporting means of the absorption roller 44, as shown in FIGS. 3 and 4, comprises springs 60 each having upper and lower loops. The upper loop of the spring 60 is coupled to a lateral side of the raised lifting member 54 and the lower loop of the spring 60 is coupled to a lateral side of the guiding member 52 or a predetermined position of the body 4. Under the influence of the elasticity of the springs 60 and the weight of the absorption roller 44, the lifting member 54 and the absorption roller 44 are elastically movable upward and downward.

With the above described configuration, as shown in FIG. 1, as the washed mat 6 passes between the absorption roller 44 and the vacuum suction device 36 in a state wherein an outer peripheral surface of the absorption roller 44 comes into contact with the guide rollers 38 and 40 and the vacuum suction device 36, the moisture, impurities, and bacteria contained in the lower surface of the mat 6 is vacuum suctioned in by the vacuum suction device 36, and the moisture, impurities, and bacteria contained in the upper surface of the mat 6 is absorbed by the absorption roller 44.

Immediately after the mat 6 exits the guiding roller 40, under the influence of the elasticity of the springs 60 and the weight of the absorption roller 44, the absorption roller 44 is lowered and comes into contact with the suction holes 62 of the vacuum suction device 36 by a predetermined period. This enables the moisture absorbed by the absorption roller 44 to be suctioned and removed by the vacuum suction device 36. As a result, the absorption roller 44 is always maintained to effectively absorb the moisture in the next mat 6.

In brief, the absorption roller 44, having the lifting and elastic supporting means, can absorb and remove the moisture of the mat 6 as it is appropriately raised or lowered corresponding to the thickness or surface conditions of the mat 6 to appropriately pressurize the upper surface of the mat 6.

Generally, during the washing of the mat 6, the mat 6 is oriented so that the nap of the mat faces downward in order to allow the impurities on the mat 6 to fall by means of the strong wash water sprays and by gravity. Therefore, it is preferable that the vacuum suction device 36 is positioned under the mat transfer path 14.

However, without being limited to the above arrangement, the vacuum suction device 36 may be selectively installed above and/or below the mat transfer path 14. For example, when the nap of the mat exists on the upper surface of the mat 6, it is preferable to install the vacuum suction device 36 above the mat transfer path 14. Further, when the nap of the mat exits on both the upper and lower surfaces of the mat 6, or when it is desired to wash both the upper and lower surfaces of the mat 6 even if the nap exists on one of the surfaces of the mat 6, a pair of the vacuum suction devices 36 are installed above and below the mat transfer path 14, respectively.

The electric heating device 18 of the present invention is installed near the vacuum suction device 36, more particularly, at a front end and/or rear end of the vacuum suction device 36. While passing through the electric heating device 18, the mat 6, deformed and wrinkled in the washing and drying processes, is heated to the temperature from 30° C. to 60° C. by the electric heating device 18, thereby being evenly smoothened to restore the original shape thereof without damage even in the cold weather of the winter.

The electric heating device 18 takes the form of an electric heater or planar heating element, and has a control circuit or means (not shown) for automatically keeping the electric heating device 18 at a predetermined constant temperature.

The mat entrance opening 8 is bottomed by a flat inclined flat guide plate 20. Such a shape is effective to facilitate the entrance of the mat 6. Similarly, the mat exit opening 10 is bottomed by a curved or flat inclined guide plate 22, which is effective to facilitate the discharge of the completely treated mat 6.

The vacuum suction device 36 of the present invention comprises a rectangular casing 64 parallel to the guide rollers 38 and 40 and internally defining the vacuum chamber 34, a neck portion 68 defined on the top of the vacuum chamber 34, a planar portion 70 on the neck portion 68 and formed with a plurality of the suction holes 62, a tubular member 76 connected at one end thereof to the bottom of the vacuum chamber 34 and at the other end thereof to a vacuum generating device 72 via a hose 74, and a pair of end plates 78. As certain fastening means, such as for example, bolts, nuts and screws, are fastened to holes 80 of the end plates 78, or by employing certain fixing methods, such as for example, riveting and welding, the vacuum suction device 36 is fixedly coupled to the body 4.

The neck portion 68 has a width narrower than that of the vacuum chamber 34 so as to effect an improved vacuum suction efficiency. The planar portion 70, formed with the plurality of suction holes 62, effectively achieves smooth transfer of the mat 6 by virtue of its flatness.

Figure 7:
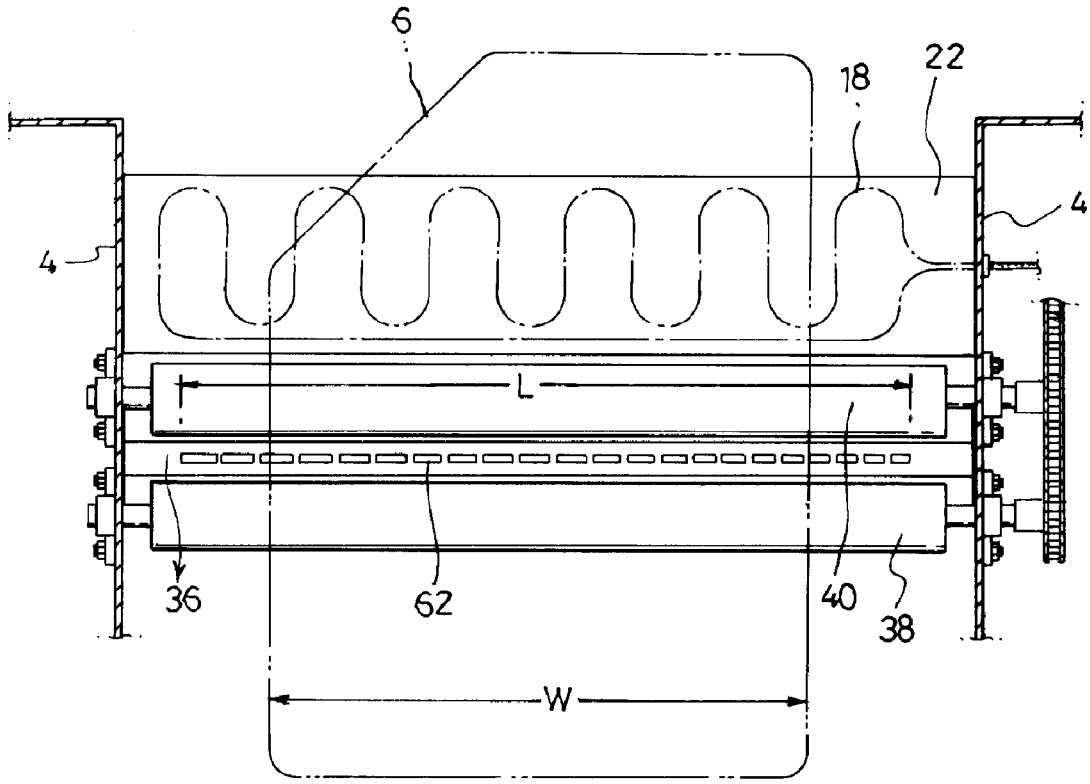
FIG. 7 is a partial plan view of an alternative configuration of the vacuum suction device shown in FIG. 6.

Referring to FIG. 7, the entire length L of a section occupied by the suction holes 62 is longer than the width W of the mat 6, so as to allow the suction force of the suction holes 62 to act over the entire width W of the mat 6.

Figure 8:
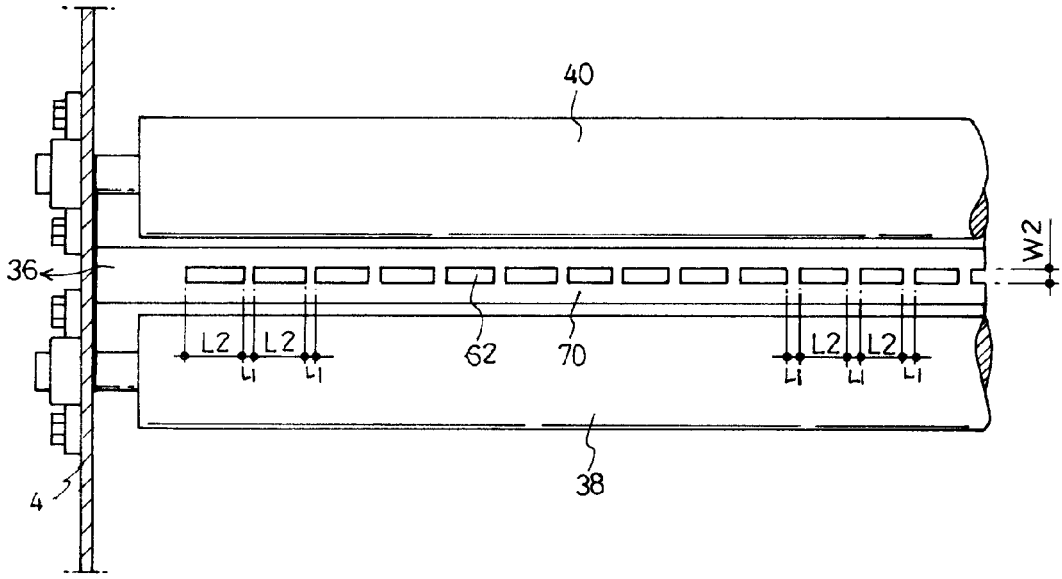
FIG. 8 is an enlarged partial plan view of the vacuum suction device according to the embodiment of the present invention.
Figure 9:
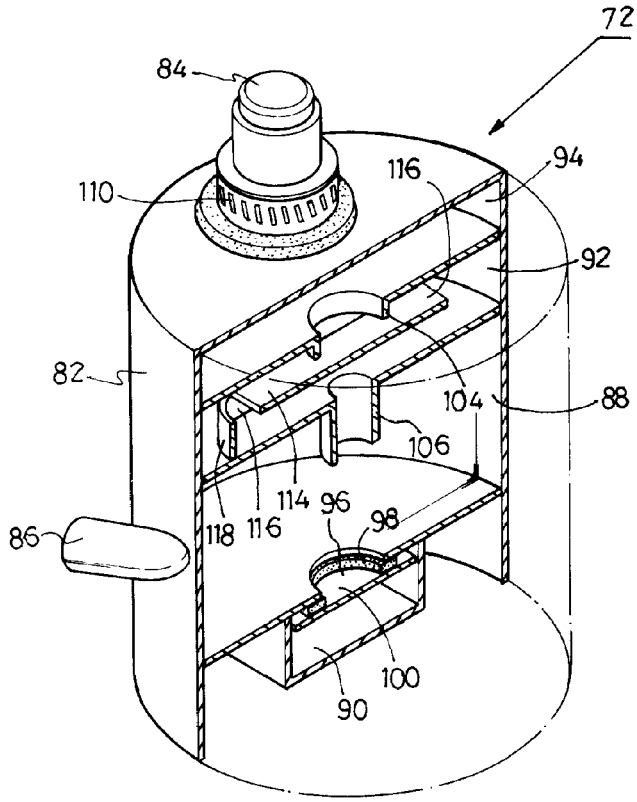
FIG. 9 is a partially cut-away perspective view of a vacuum generating device according to the embodiment of the present invention.

Referring to FIG. 8, each of the suction holes 62 has a rectangular form having a width W2 suitable to suction the moisture and impurities in the mat 6 while ensuring the easy transfer of the mat 6. Toward one end of the casing 64, the length L2 of the respective suction holes 62 gradually increases, and the distances L1 between the adjacent suction holes 62 are the same as each other. With such a configuration, the mat 6 can be smoothly transferred to and discharged from the mat exit opening 10 while ensuring effective vacuum suction of the moisture, impurities, and bacteria remaining in the mat 6, without causing the mat 6 to stick to the suction holes 62 and the planar portion 70.

The vacuum generating device 72 of the present invention comprises one or more vacuum pumps 84 centrally or circumferentially installed on the top of a casing 82, an auxiliary vacuum chamber 94 defined in an uppermost portion of the casing 82 to communicate with suction holes 85 of the vacuum pumps 84, a vortex forming chamber 92 defined under the auxiliary vacuum chamber 94 and including a vortex forming unit 112, a vacuum separation chamber 88 defined under the vortex forming chamber 92 and having a large volume sufficient to separate the moisture and impurities suctioned from the vacuum suction device 36 from air, a drain chamber 90 defined under the vacuum separation chamber 88 and adapted to discharge the separated moisture and impurities to the outside, and a plate shaped check valve 100 installed to a partition between the vacuum separation chamber 88 and the drain chamber 90 by interposing an O-ring shaped packing 98. The partition is centrally formed with a drain hole 96.

The plate shaped check valve 100 is supported at one end thereof on a hinge 102 fitted in a shaft hole 101 so as to be automatically opened or closed upon receiving a vacuum pressure. That is, if the vacuum pressure is applied to the vacuum separation chamber 88 under operation of the vacuum pumps 84, the check valve 100 is pivotally rotated upward about the hinge 102 and comes into close contact with the packing 98 to close the drain hole 96, resulting in airtightness of the vacuum separation chamber 88.

Then, if the operation of the vacuum pumps 84 stops and the vacuum of the vacuum separation chamber 88 is released, the check valve 100 is pivotally rotated downward about the hinge 102 by gravity to open the drain hole 96, thereby allowing the moisture, impurities, and bacteria, separated in the vacuum separation chamber 88, to be discharged to the outside through the drain hole 96, the drain chamber 90 and discharge pipes 108 and 48.

Figure 10:
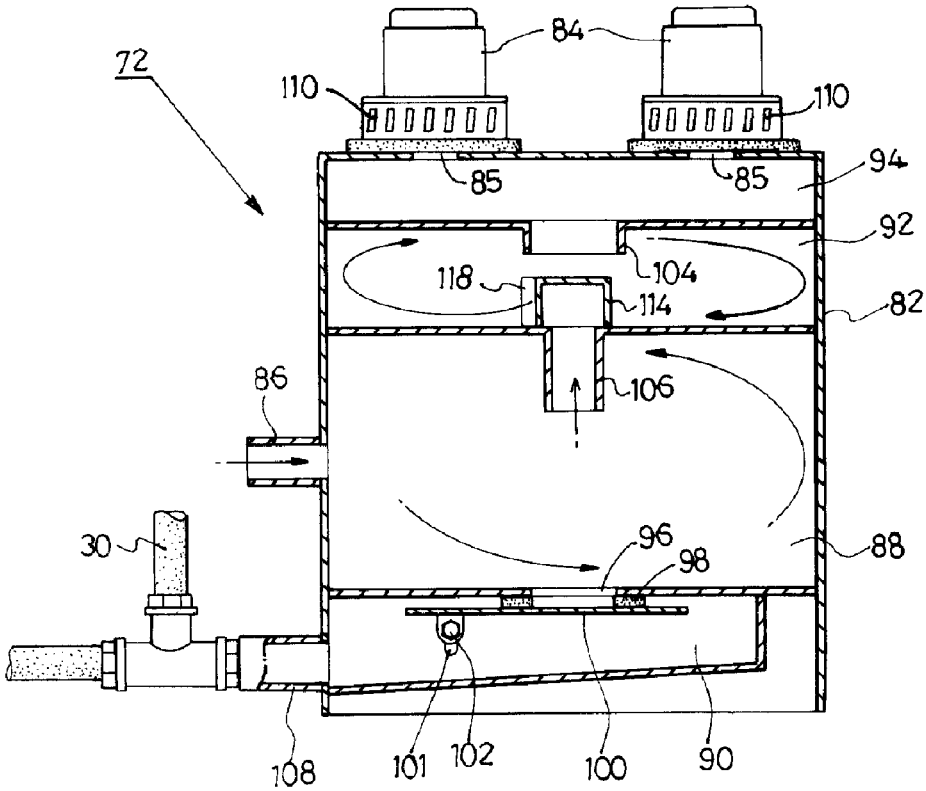
FIG. 10 is a front sectional view of the vacuum generating device according to the embodiment of the present invention, in a state wherein a check valve is closed.
Figure 11:
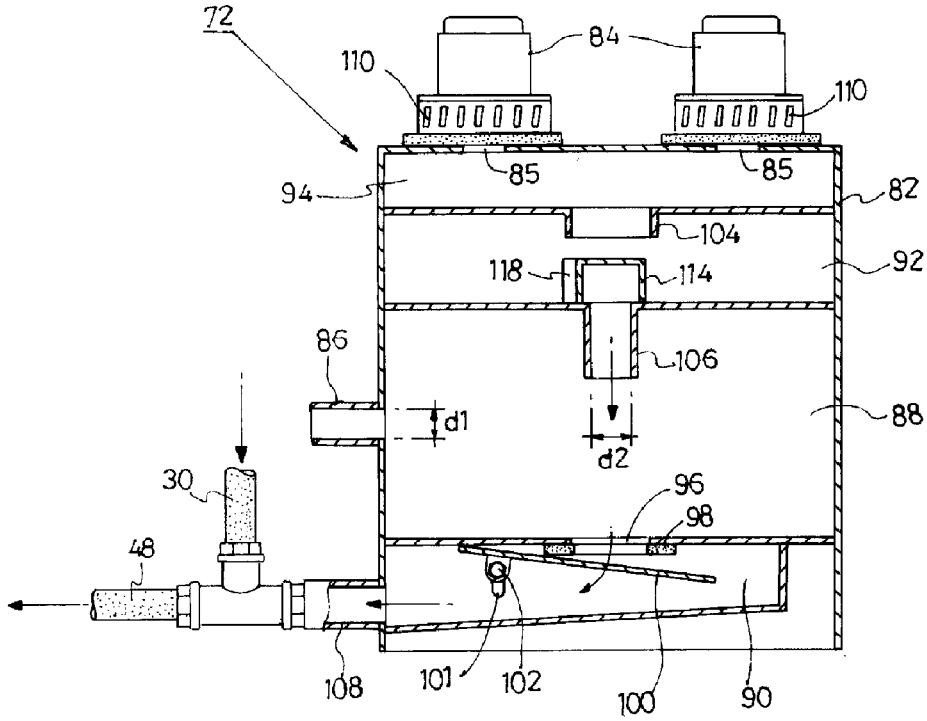
FIG. 11 is a front sectional view of the vacuum generating device according to the embodiment of the present invention, in a state wherein the check valve is opened.

In the present invention, as a result of interposing the packing 98 between the partition and the check valve 100, as shown in FIGS. 10 and 11, the shaft hole 101 has a vertically elongated rectangular form for allowing the hinge 102 to vertically move to some extent. This enables the check valve 100 to come into close contact with the entire surface of the packing 98. That is, the vertical height of the shaft hole 101 is determined in consideration of the height of the packing 98 so as to allow the check valve 100 to come into close contact with the packing 98.

Although the auxiliary vacuum chamber 94, the vortex forming chamber 92, the vacuum separation chamber 88 and the drain chamber 90 are separated from one another by means of respective partitions, the auxiliary vacuum chamber 94 and the vortex forming chamber 92 communicate with each other via a tubular member 104 having a relatively large inner diameter, and the vortex forming chamber 92 and the vacuum separation chamber 88 communicate with each other via a tubular member 106 having an inner diameter d2 smaller than that of the tubular member 104. The vacuum separation chamber 88 is externally installed with a suction pipe 86, which is connected to the vacuum suction device 36 by way of the hose 74. Meanwhile, the vacuum pumps 84 are formed with exhaust holes 110 along lower end regions thereof for discharging the air from the vacuum separation chamber 88 to the outside.

Figure 12:
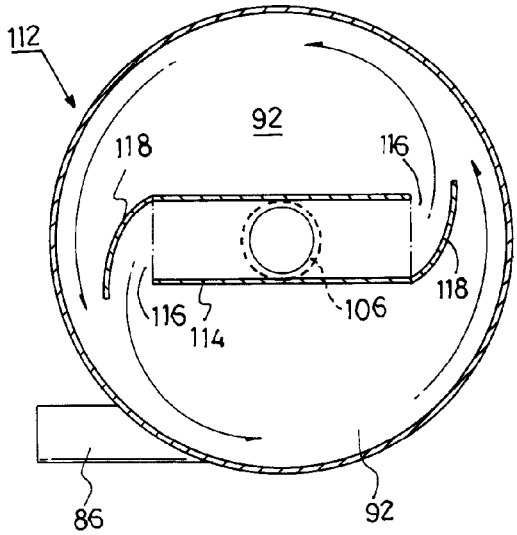
FIG. 12 is a plan view of a rotating vortex forming unit of the vacuum generating device according to the embodiment of the present invention.

The air stream, suctioned into the vacuum generating device, flows upward through the tubular members 106 and 104 centrally formed at the partitions, and as shown in FIG. 12, the suction pipe 86 is connected to the vacuum separation chamber 88 to face an inner circumference of the chamber 88, rather than the center of the chamber 88. With such a configuration, the air, the moisture and impurities, introduced into the vacuum separation chamber 88, can be effectively separated from each other as they form vortex. The separated air flows upward, whereas the moisture and impurities converge into the center drain hole 96 having a relatively large diameter, resulting in easy discharge of the moisture and impurities.

Preferably, in order to maximize convergence of the moisture and impurities into the center drain hole 96, within a range of ensuring sufficient functioning of the check valve 100, the partition between the vacuum separation chamber 88 and the drain chamber 100 is configured so that the thickness thereof gradually increases towards its center. Further, the bottom of the drain chamber 90 is tilted toward the discharge pipe 108 for facilitating the discharge of the moisture and impurities.

The suction pipe 86 installed lateral to the casing 82 has an inner diameter d1, which is equal to the inner diameter d2 of the tubular member 106 centrally installed at the vacuum separation chamber 88. This allows the vacuum pressure of the vacuum separation chamber 88 to be completely transmitted to the vacuum chamber 34 of the vacuum suction device 36 without loss. The tubular member 104 of the auxiliary vacuum chamber 94 has a height smaller than that of the tubular member 106 of the vacuum separation chamber 88 having a high moisture content. This has the effect of preventing part of the moisture passing through the tubular member 106 from reaching the vacuum pumps 84.

The vortex forming unit 112 installed in the vortex forming chamber 92 serves to separate the moisture passing through the tubular member 106 from the air, and to guide the separated moisture downward.

Referring to FIG. 12, which is a plan view of the vortex forming unit 112, the vortex forming unit 112 comprises a rectangular casing 114 having a pair of openings 116 formed at opposite sides thereof. Upper and lower surfaces as well as front and rear surfaces of the casing 114 are closed.

The casing 114 of the vortex forming unit 112 is centered at the bottom thereof to the tubular member 106 in order to allow the passage of the air therethrough. To the openings 116 formed at opposite sides of the casing 114 are connected curved plates 118, respectively, so that the openings 116 are opened in opposite directions as each other. With such a configuration, the air, flowing into the vortex chamber 92 upon receiving the vacuum pressure, rotates counterclockwise and forms a vortex. The formation of the vortex restricts the passage of the moisture heavier than the air.

Referring to FIGS. 3 and 4 illustrating power transmission means of the mat vacuum cleaning machine 2, the power transmission means comprises a pulley 120 fixed around the rotating shaft of the motor 12, a pulley 122 fixed around the shaft rod of the brush roller 28, an idle pulley 124, and a pulley 128 fixed at an end of a lower connection shaft rod 126. The pulleys 120, 122, 124 and 128 are connected to one another by means of a belt 130 to effect a reduction in rotational speed of the rollers. The power transmission means further comprises a pulley 132 fixed at the other end of the lower connection shaft rod 126, and a pulley 136 fixed at an end of an upper connection shaft rod 134, which are connected to each other by means of another belt 130' to effect a reduction in rotational speed of the rollers. The brush roller 28 associated with the pulley 122 has a high rotational speed, but the other rollers 26, 38, 40 and 44 are largely reduced in their rotational speeds under cooperation of the pulleys 124, 128, 132 and 136. Therefore, the mat 6 can be transferred and discharged at an appropriately controlled speed suitable for carrying out the washing, vacuum suction and drying processes.

The pulleys 122, 124 and 128 take a double structure wherein a large diameter pulley and a small diameter pulley are integrally formed to each other for improving speed reduction efficiency thereof. The vacuum pressure applied to the vacuum suction device 36 is kept within an effective range for suctioning the moisture, impurities and bacteria in the mat 6 while ensuring smooth transfer of the mat 6.

The upper connection shaft rod 134, which is coupled to the body 4, as shown in FIG. 3, is mounted at one end thereof with a gear 138. Similarly, a shaft rod 140, coupled to the body 4 and located below the gear 138, is mounted at one end thereof with a gear 142. The gear 142 and the gear 138 are engaged with each other to rotate in opposite directions as each other.

A plurality of chain gears 144, 146, 148, 150, 152 and 154 are installed to the shaft rods of the driving roller 26, the guide rollers 38 and 40, the absorption roller 44, the upper connection shaft rod 134 and the shaft rod 140, respectively. Additionally, a chain gear 162 is installed to the shaft rod of the guide roller 38 to cooperatively rotate with the guide roller 38.

The chain gear 152, fixed at the upper connection shaft rod 134, is connected to the chain gear 150, fixed at the shaft rod of the adsorption roller 44, by means of a chain 156, so as to rotate counterclockwise as shown in FIG. 4. On the other hand, the chain gears 146 and 148, fixed at the shaft rods of the guide rollers 38 and 40, are connected to the chain gear 154 fixed at the shaft rod 140 by means of a chain 158, so as to rotate clockwise. Further, the chain gear 144 fixed at the shaft rod of the driving roller 26 and the chain gear 162 fixed at the shaft rod of the guide roller 38 are connected to each other by means of a chain 160 so as to rotate clockwise. Through rotation of the connected respective chain gears, the mat 6 is transferred toward the mat exit opening 10.

Considering power transmission of the brush roller 28, a driving power of the motor 12 is transmitted to the brush roller 28 via the pulley 122, so as to rotate the brush roller 28. In this case, the rotational speed of the brush roller 28 is relatively high, but is lower than the rotational speed of the motor 12.

Considering power transmission of the absorption roller 44, the driving power of the motor 12 is transmitted, in sequence, to the pulley 122, the idle pulley 124, the pulley 128 fixed at the end of the lower connection shaft rod 126, the lower connection shaft rod 126, and the pulley 132 fixed at the opposite end of the lower connection shaft rod 126, the pulley 136 fixed at the upper connection shaft rod 134, the upper connection shaft rod 134, the chain gear 152 fixed at the upper connection shaft rod 134, the chain 156, the chain gear 150, and the shaft rod 45 of the absorption roller 44, so as to rotate the absorption roller 44 counterclockwise.

Considering power transmission of the guide rollers 38 and 40, the driving power of the motor 12 is transmitted, in sequence, to the pulley 122, the pulley 124, the pulley 128, the lower connection shaft rod 126, the pulley 132, the pulley 136 fixed at the upper connection shaft rod 134, the upper connection shaft rod 134, the gear 138, the gear 142, the shaft rod 140, the chain gear 154, the chain 158, and the chain gears 146 and 148 fixed at the shaft rods of the guide rollers 38 and 40, so as to rotate the guide rollers 38 and 40 clockwise.

Considering power transmission of the driving roller 26, the driving power of the motor 12 is transmitted, in sequence, to the pulley 122, the pulley 124, the pulley 128, the lower connection shaft rod 126, the pulley 132, the pulley 136 fixed at the upper connection shaft rod 134, the upper connection shaft rod 134, the gear 138, the gear 142, the shaft rod 140, the chain gear 154, the chain 158, the guide roller 38, the chain gear 162, the chain 160, and the chain gear 144 fixed at the shaft rod of the driving roller 26, so as to rotate the driving roller 26 clockwise.

In the above description, the absorption roller 44 located above the mat transfer path 14, rotates in the opposite direction as the driving roller 26, the brush roller 28 and the guide rollers 38 and 40, which are located under the mat transfer path 14. That is, considering the above described rotating direction with reference to FIG. 4, when the engaged upper and lower gears 138 and 142 rotate in opposite directions as each other to transmit the driving power, the absorption roller 44 rotates counterclockwise, and the driving roller 26, the brush roller 28 and the guide rollers 38 and 40 rotate clockwise, so as to discharge the mat 6.

Now, the sequential operation and effects of the vacuum cleaning machine 2 according to the present invention will be explained.

First, as soon as the mat 6 enters the vacuum cleaning machine 2, the pressure roller 42 pressurizes the upper surface of the mat 6 under the influence of the elastic supporting means, such as the springs, and gravity.

Then, after washing completion, the mat 6 is conveyed to the vacuum suction device 36 so that the majority of the moisture and impurities remaining in the mat 6 is vacuum suctioned and removed. Successively, the washed and dried mat 6 is adapted to pass through the electric heating device 18 so that the mat, which was inevitably deformed and wrinkled in the previous washing and drying processes, can restore its original shape as it is heated to a predetermined high temperature by means of the electric heating device 18. In this way, the mat 6 can reach an immediately usable condition without additional drying processes. In the present invention, the vacuum suction process can remove various bacteria and bad odors of the mat 6 as well as the moisture and impurities in the mat 6, maximizing the clearness of the automotive passenger compartment using the mat 6 according to the present invention.

In the present invention, the guide rollers 38 and 40 are located at opposite sides of the suction holes 62 at a level higher than the suction holes 62. The guide roller 40, located near the mat exit opening 10, serves to pull the mat 6 held between the guide roller 40 and the absorption roller 44 in cooperation with the absorption roller 44, and to transfer the mat 6 toward the mat exit opening 10. The guide roller 38, located near the mat entrance opening 8, serves to push the mat 6 toward the guide roller 40 in cooperation with the absorption roller 44. Due to the fact that the suction holes 62, longitudinally arranged on the top of the casing 64, are configured so that the length of the respective suction holes 62 gradually increases toward the one end of the casing 64 to achieve a variable suction force, even if a relatively strong vacuum is applied to the mat 6, the mat 6 can be smoothly discharged from the mat exit opening 10 without sticking to the suction holes 62 and the planar portion 70.

Figure 13:
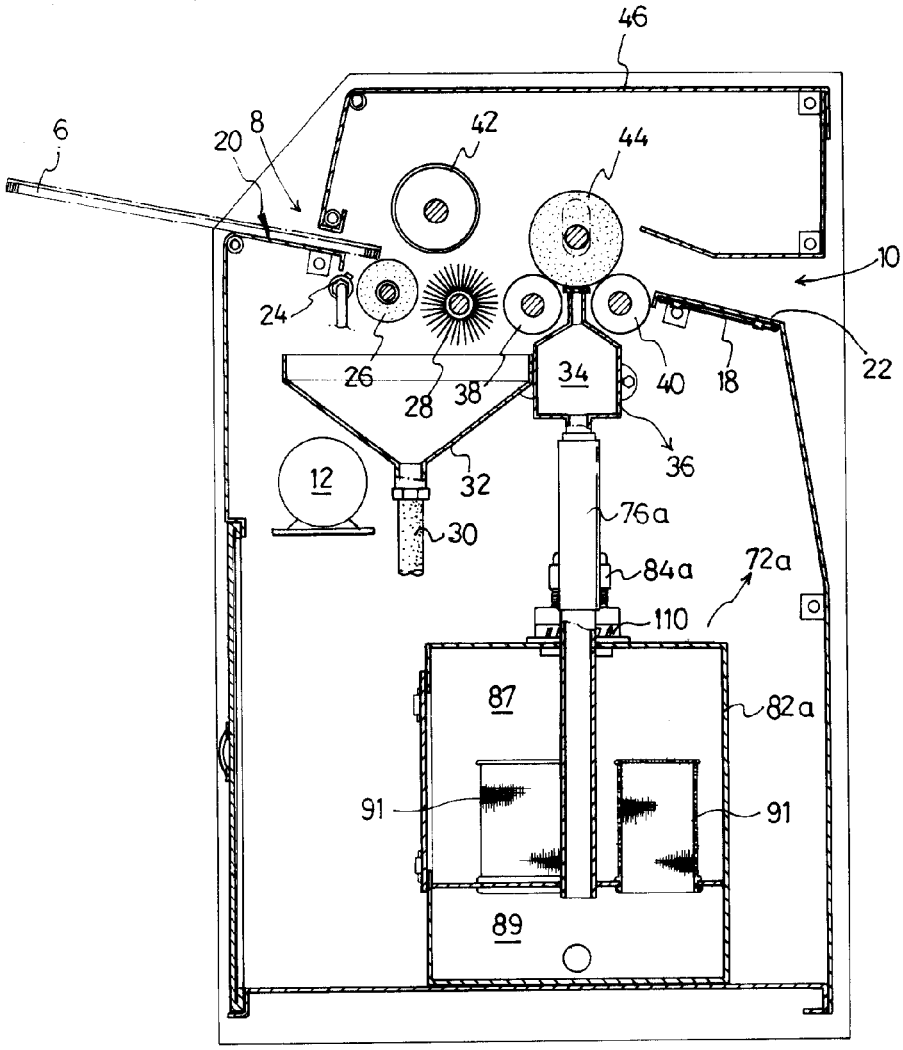
FIG. 13 is a front sectional view of a vacuum cleaning machine according to another embodiment of the present invention.
Figure 14:
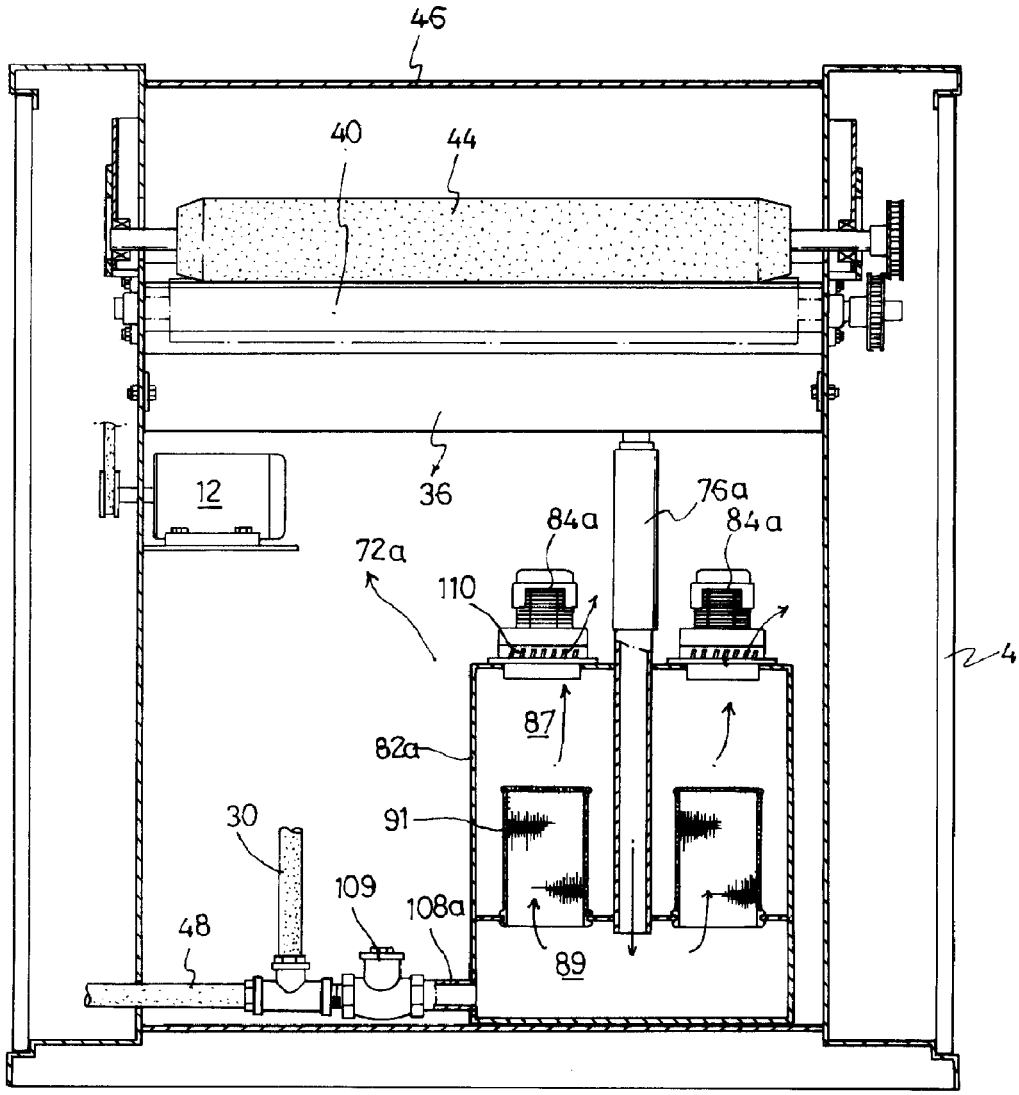
FIG. 14 is a partial side sectional view of a vacuum suction device shown in FIG. 13.

FIGS. 13 and 14 are front and side sectional views, respectively, illustrating a mat vacuum cleaning machine according to another embodiment of the present invention.

In the present embodiment, a vacuum generating device 72*a* comprises one or more vacuum pumps 84*a* centrally or circumferentially installed on a casing 82*a*, and upper and lower vacuum chambers 87 and 89, which are defined in the casing 82*a* and are separated from each other by means of a partition 83. One or more filters 91 are separably installed to the casing 82*a* to be located in the upper vacuum chamber 87. A discharge pipe 108*a* is connected at one end thereof to the lower vacuum chamber 89, and at the other end thereof to a check valve 109. A tubular member 76*a* connected to the vacuum suction device 36 extends into the casing 82*a* so that it extends down to the lower vacuum chamber 89 by passing through the partition 83.

With the above described configuration, the air, separated by the filters 91, is discharged to the outside through the vacuum pumps 84*a*, and the moisture, impurities and bacteria are filtered while passing through the filters 91, thereby being discharged through the discharge pipe 108*a* and the check valve 109. The check valve 109 is closed under vacuum, and is then opened at the same time as the removal of the vacuum.

In order to sterilize harmful bacteria in the mat 6, bactericides harmless to the human body may be mixed in the wash water, or ozonated water may be used in the washing process. Alternatively, an ozone generator may be installed on the mat transfer path 14.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As apparent from the above description, the present invention is available for a field for washing mats of vehicles, such as passenger gars, and buses.

The invention claimed is:

1. A mat vacuum cleaning machine comprising:

a vacuum suction device installed at a rear end of a mat transfer path so as to be parallel to mat transfer rollers, the mat transfer path being defined in a body of the machine for the transfer of a mat that is washed by water, the vacuum suction device including a plurality of suction holes perforated in an upper surface of a neck portion inside a vacuum chamber thereof, the length of the respective suction holes gradually increasing toward one side of the vacuum suction device to apply a uniform vacuum suction force to the washed mat coming into contact with the upper surface, so as to vacuum suction moisture, impurities and bacteria remained in the washed mat while allowing the mat to be smoothly transferred to a mat exit opening of the body; and a vacuum generating device connected to a tubular suction member of the vacuum suction device by use of a hose and adapted to create a vortex of the moisture, impurities, and bacteria introduced through the hose, so as to separate the moisture, impurities and bacteria from vacuum suctioned air and guide the air upward toward one or more vacuum pumps.

2. The machine as set forth in claim 1, further comprising:

one or more electric heating devices installed at a front end and/or a rear end of the vacuum suction device.

3. The machine as set forth in claim 2, wherein the electric heating device has a predetermined heating temperature from 30° C. to 60° C.

4. The machine as set forth in claim 1 or 2, wherein the vacuum suction device includes:

a vacuum chamber communicating with the vacuum generating device;

a neck portion defined on the top of the vacuum chamber; and the plurality of suction holes longitudinally arranged on the top of the neck portion.

5. The machine as set forth in claim 4, wherein the suction holes are equidistantly spaced apart from one another, and the length of the respective suction holes gradually increases toward one end of the vacuum suction device.

6. The machine as set forth in claim 1 or 2, wherein a pair of parallel guide rollers are installed at opposite sides of the vacuum suction device so that they are positioned higher than an uppermost planar portion of the vacuum suction device.

7. The machine as set forth in claim 1 or 2, wherein two vacuum suction devices are installed above and below a mat transfer path, respectively.

8. The machine as set forth in claim 1 or 2, wherein the vacuum generating device includes:

vacuum pumps installed on a casing;

an auxiliary vacuum chamber communicating with suction holes of the vacuum pumps;

a vortex forming chamber defined under the auxiliary vacuum chamber and including a vortex forming unit;

a vacuum separation chamber defined under the vortex forming chamber and adapted to separate moisture and impurities suctioned in by the vacuum suction device from air;

a drain chamber defined under the vacuum separation chamber;

a plate shaped check valve installed to a partition between the vacuum separation chamber and the drain chamber by interposing an O-ring shaped packing, the partition having a drain hole; and a tubular member connected to a tubular member of the vacuum suction device via a hose.

9. The machine as set forth in claim 8, wherein the tubular member of the vacuum suction device has the same inner diameter as that of the tubular member of the vacuum separation chamber.

10. The machine as set forth in claim 8, wherein the tubular member of the vacuum separation chamber is directed at an angle in a circumferential direction of the casing.

11. The machine as set forth in claim 1 or 2, wherein the vacuum generating device includes:

vacuum pumps installed on a casing;

upper and lower vacuum chambers defined in the casing and separated from each other by means of a partition;

one or more filters separably coupled to the casing to be located in the upper vacuum chamber;

a discharge pipe connected to the lower vacuum chamber;

a check valve installed at an end of the discharge pipe; and a tubular member connected to the vacuum suction device, the tubular member extending into the casing to communicate with the lower vacuum chamber by passing through the partition.

* * * * *